US009163547B2

(12) United States Patent
Wirth

(10) Patent No.: US 9,163,547 B2
(45) Date of Patent: Oct. 20, 2015

(54) LIGHTWEIGHT CONSTRUCTION SILENCER

(71) Applicant: Eberspächer Exhaust Technology GmbH & Co. KG, Neunkirchen (DE)

(72) Inventor: Georg Wirth, Kirchheim/Teck (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 13/916,131

(22) Filed: Jun. 12, 2013

(65) Prior Publication Data

US 2013/0333977 A1 Dec. 19, 2013

(30) Foreign Application Priority Data

Jun. 13, 2012 (DE) ..... 10 2012 209 932

(51) Int. Cl.

| | |
|---|---|
| ***F01N 13/00*** | (2010.01) |
| ***F01N 13/14*** | (2010.01) |
| ***F01N 13/18*** | (2010.01) |
| ***F01N 1/08*** | (2006.01) |

(52) U.S. Cl.

CPC ..... *F01N 13/007* (2013.01); *F01N 1/084* (2013.01); *F01N 13/141* (2013.01); *F01N 13/148* (2013.01); *F01N 13/1872* (2013.01); *F01N 13/1894* (2013.01); *F01N 2450/24* (2013.01); *F01N 2490/08* (2013.01); *F01N 2490/155* (2013.01); *F01N 2530/26* (2013.01)

(58) Field of Classification Search

CPC . F01N 13/141; F01N 13/148; F01N 13/1894; F01N 13/007; F01N 13/1872; F01N 2490/08; F01N 2490/155; F01N 2530/26; F01N 2450/24; F01N 1/084

USPC ..... 181/251, 257, 264, 268, 275, 282

See application file for complete search history.

(56) References Cited

U.S. PATENT DOCUMENTS

| | | | | | |
|---|---|---|---|---|---|
| 4,860,853 | A | * | 8/1989 | Moring, III | 181/282 |
| 4,909,348 | A | * | 3/1990 | Harwood et al. | 181/282 |
| 5,597,986 | A | * | 1/1997 | Harwood et al. | 181/282 |
| 5,739,484 | A | * | 4/1998 | Jones | 181/264 |
| 5,859,394 | A | * | 1/1999 | Seehaus et al. | 181/282 |
| 6,164,412 | A | * | 12/2000 | Allman | 181/272 |

(Continued)

FOREIGN PATENT DOCUMENTS

| | | |
|---|---|---|
| EP | 2 514 941 A1 | 10/2012 |
| FR | 2 480 350 A1 | 10/1981 |

(Continued)

OTHER PUBLICATIONS

Chinese Office Action of May 6, 2015.

*Primary Examiner* — Jeremy Luks

(74) *Attorney, Agent, or Firm* — McGlew and Tuttle, P.C.

(57) ABSTRACT

A silencer (1; 1') for an exhaust system of an internal combustion engine, in particular of a motor vehicle, includes a housing (2; 2'), which includes a housing shell (3; 3') extending in a circumferential direction (U) of the housing (2; 2'). At least one sandwich plate (6; 6') forms a part of the housing shell (3; 3'). A housing interior space (4) including at least one chamber (8), is enclosed by the housing (2). A self-supporting support structure (5) is provided, which includes a pipe arrangement (7) that is at least partially arranged in the housing interior space (4).

13 Claims, 4 Drawing Sheets

(56) References Cited

U.S. PATENT DOCUMENTS

| | | | | |
|---|---|---|---|---|
| 6,199,659 | B1 * | 3/2001 | Allman | 181/282 |
| 6,659,222 | B1 * | 12/2003 | Allman | 181/282 |
| 6,681,889 | B2 * | 1/2004 | Collmer et al. | 181/251 |
| 6,892,852 | B2 * | 5/2005 | Klein | 181/227 |
| 7,273,129 | B2 * | 9/2007 | Harwood | 181/256 |
| 8,011,471 | B2 * | 9/2011 | Zheng | 181/282 |
| 2002/0108428 | A1 | 8/2002 | Klein | |
| 2009/0188747 | A1 * | 7/2009 | Smatloch et al. | 181/282 |
| 2010/0116586 | A1 * | 5/2010 | Andre et al. | 181/282 |
| 2010/0307865 | A1 * | 12/2010 | Olsen | 181/272 |

FOREIGN PATENT DOCUMENTS

| | | | |
|---|---|---|---|
| GB | 2 352 480 | A | 1/2001 |
| JP | 3 160 109 | A | 7/1991 |
| JP | H08-246842 | A | 9/1996 |
| JP | H09-242526 | A | 9/1997 |
| JP | 2005-155366 | A | 6/2005 |
| JP | 2006-063849 | A | 3/2006 |
| WO | 2012/055949 | A1 | 5/2012 |

* cited by examiner

LIGHTWEIGHT CONSTRUCTION SILENCER

CROSS REFERENCE TO RELATED APPLICATIONS

This application claims the benefit of priority under 35 U.S.C. §119 of German Patent Application DE 10 2012 209 932.8 filed Jun. 13, 2012, the entire contents of which are incorporated herein by reference.

FIELD OF THE INVENTION

The present invention relates to a silencer (also known as a muffler) for an exhaust system of an internal combustion engine, in particular of a motor vehicle. The invention furthermore relates to an exhaust system having such a silencer and to an internal combustion engine having such an exhaust system.

BACKGROUND OF THE INVENTION

Silencers usually comprise a housing, which encloses a silencer volume, and at least one inlet pipe and at least one outlet pipe. By way of the inlet pipe and the outlet pipe the silencer can then be fluidically connected to the remaining exhaust system. Apart from this, the silencer can comprise at least one holding element, with which the silencer can be fastened to a holding structure, for example of the internal combustion engine of a motor vehicle. In vehicle applications it is usual to install the exhaust system along an underbody of the motor vehicle. Since only comparatively little installation space is available in the underbody region, silencers can be designed comparatively flat, while their housing can then comprise at least one flat wall region, which in the assembled state faces the underbody of the motor vehicle or also a road surface.

To reduce the fuel consumption of the motor vehicle using the silencer it can be practical to reduce the vehicle weight as far as possible. Consequently, there is also a need for the silencer installed in a motor vehicle to be produced as light as possible and consequently with reduced wall thicknesses. In this connection, housings are problematic which, as explained above, have at least one flat wall region. For the smaller the wall thickness of such a flat wall region is, the greater is the tendency to vibration excitation, which can lead to interfering noises during the operation of the silencer and to damages, in particular of mechanical fastening points.

SUMMARY OF THE INVENTION

The present invention deals with the problem of providing an improved embodiment for a silencer of the type mentioned at the outset, which is suitable in particular for realizing a lightweight construction.

According to the invention, a silencer is provided for an exhaust system of an internal combustion engine, in particular of a motor vehicle. The silencer comprises a housing, which includes a housing shell extending in a circumferential direction of the housing. At least one sandwich plate forms a part of the housing shell. A housing interior space, including at least one chamber, is enclosed by the housing. A self-supporting support structure is provided, which includes a pipe arrangement that is at least partially arranged in the housing interior space.

The silencer according to the invention comprises at least one sandwich plate, wherein this sandwich plate forms a part of a housing shell of the housing of the silencer. The silencer furthermore comprises a self-supporting support structure, which in turn comprises a pipe arrangement, which is at least partially arranged in the housing interior space. This pipe arrangement can comprise for example an exhaust gas feed line and an exhaust gas discharge line, by means of which exhaust gas from an exhaust system of an internal combustion engine including the sound to be dampened can be fed to the silencer and discharged again from the latter. By means of the silencer according to the invention, both forces as well as mechanical bending moments, which are generated by the exhaust system of the internal combustion engine or also by the internal combustion engine itself, can be absorbed by the pipe arrangement and channeled through the silencer.

In this way, an undesirable introduction of such forces or mechanical bending moments into the actual housing of the silencer can be avoided, so that such housing in turn can be configured correspondingly thin-walled. By means of the self-supporting support structure the pipe arrangement in this case can be supported in the housing of the silencer in a mechanically stable manner.

Forces or torques fed to the silencer from a feed line of the pipe arrangement are thus directly transmitted to a discharge line of the pipe arrangement via the self-supporting support structure and thus again discharged from the silencer, without the housing of the silencer itself having to absorb these forces. To connect the silencer to an underbody of a motor vehicle, the sandwich plate according to the invention can be used, which for the optimal fastening of the silencer to the underbody is designed flat yet has a very high mechanical stability. Thus, the silencer according to the invention can also be mounted in the installation space which in a motor vehicle is usually greatly limited and, if required, formed suitably flat for this purpose. Since the sandwich plate is composed of a plurality (for example 4 to 5) individual sheet metal wall layers, wherein each such sheet metal wall layer can have a thickness of approximately 0.1 mm, the overall weight of such a sandwich plate compared with conventional sheet metal walls with a sheet metal wall thickness of approximately 1.5 mm is clearly reduced and thus particularly suitable for stiffening large areas. Advantageously, the sandwich plate (wall), in its simplest form, comprises a top and a bottom metal layer (preferably a metal sheet) with a cell structure layer placed in between the two metal sheet layers. The cell structure layer can, for example, have a honeycomb-like structure layer or any other appropriate cell structure layer providing low weight and high mechanical stiffness simultaneously. The cell structure layer can be mounted to the top metal layer and the bottom metal layer by welding or soldering. In preferred embodiments, several individual cell structure layers can be arranged in between the top and bottom layers, separated by intermediate metal sheets or the like. By using sandwich plates in silencers (instead of conventional sheet metal walls), a substantial weight saving can thus be achieved. The silencer according to the invention can consequently be produced in lightweight construction, wherein it is ensured at the same time that the mechanical stability necessary for absorbing and transmitting forces or mechanical bending moments fed to the silencer is available.

Preferentially, the at least one sandwich plate is part of the self-supporting support structure. This makes possible a particularly good transmission of forces or torques fed to the silencer via the self-supporting support structure, for example to a discharge line of the pipe arrangement.

In an embodiment which is alternative to this or a further development of this, the self-supporting support structure can comprise at least one intermediate floor. Such an intermediate floor can be used for supporting the pipe arrangement on the self-supporting support structure and thus further improve the mechanical stability of the silencer.

In a preferred embodiment, the silencer can comprise a shell hood, which completes the first sandwich plate to form the housing shell of the housing of the silencer according to the invention. This means that the entire housing of the silencer is formed through the first sandwich plate and such a shell hood. This makes possible a silencer which is mechanically stable yet can be produced in a technically very simple manner, so that the production costs of such a silencer can be relatively low.

Alternatively, the silencer can comprise a further sandwich plate, which is part of the self-supporting support structure, and a first and a second sheet metal wall, which together complete the first sandwich plate to form the housing shell. In this way, the mechanical stability of the silencer according to the invention can be further increased, since the further sandwich plate as part of the self-supporting support structure can also absorb and pass on forces or moments introduced into the silencer. Accordingly, the first and second sheet metal wall can each be produced in a thin-walled manner, i.e. in a light-weight manner and can also be designed and produced cost-effectively since the two sheet metal walls do not have any load-bearing function and they do not have to absorb any forces introduced into the silencer.

In a mechanically particularly stable, further-developing embodiment, the sandwich plate and the further sandwich plate as well as the first and second sheet metal wall can be arranged in a cross-sectional profile of the silencer substantially located opposite one another.

In a further-developing embodiment, it can be considered that the silencer comprises a first and a second end bottom, which complete the housing shell to form the housing. To this end, the first or second end bottom can each be glued, soldered or welded to the housing shell, so that the housing shell with the two end bottoms forms a gas-tight housing. Since the two end bottoms do not have any load-bearing function either, these can also be formed preferentially as thin sheet metal walls. In an embodiment that is particularly easy to produce, and also particularly light-weight, the shell hood can be integrally joined to the first or/and to the second end bottom. This means that the shell hood as well as the first and second end bottom form a single work piece, which in the manner of a hood can be joined to the sandwich plate and in particular welded to the latter. The shell hood which is integrally joined to the first and second end bottom in this case can be formed in the manner of a shell.

In order to be able to ensure a mechanically particularly stable fastening of the shell hood to the sandwich plate, the shell hood, in a particularly preferred embodiment, can comprise two marginal portions in a longitudinal section profile of the silencer for attaching to the at least one sandwich plate, which marginal portions project to the outside, away from the housing interior space of the silencer, or to the inside, towards the housing interior space.

In an embodiment which is particularly simple to produce, at least one of the two sheet metal walls can be integrally joined to the first or to the second end bottom.

For effectively introducing the sound to be dampened by the silencer according to the invention, the first or/and second end bottom of the silencer can each have a first or second through-opening. The pipe arrangement in this case can comprise at least one feed pipe and one discharge pipe with a feed opening or discharge opening, which are introduced into and channeled through the housing interior space through the first or second through-opening in such a manner that the feed opening or discharge opening is arranged in the at least one chamber of the silencer.

In order to further increase the mechanical stability of the silencer according to the invention, so that the silencer is able to absorb particularly high forces or bending moments introduced into the silencer, the at least one intermediate floor can comprise a first and a second end portion, wherein the first end portion can then support itself on the first sandwich plate and the second end portion on the further sandwich plate or on the shell hood. In the intermediate floor, at least one through-opening can be provided in a region arranged between the two end portions, through which the at least one feed or discharge pipe can be channeled. In this way, the feed or discharge pipe can be supported in the silencer in a mechanically particularly stable manner.

In a particularly preferred embodiment, the at least one intermediate floor can be an additional sandwich plate (in addition to the first and second sandwich plate). In this case, a particularly high mechanical stability can be achieved in the silencer according to the invention by means of the additional sandwich plate. Alternatively, the at least one intermediate floor can also be a sheet metal wall. This variant is preferable in particular when the mechanical stability need not be substantially increased by means of the intermediate floor, so that the sheet metal wall can serve for example as a pure separating wall for dividing the chamber in the housing interior space into a first and a second sub-chamber, by means of which sound introduced into the silencer can be dampened in a particularly favorable manner.

In an embodiment which is particularly simple and cost-effective to produce, the sandwich plate can be joined to the further sandwich plate or the shell hood by means of welding, gluing or soldering.

In order to be able to fasten the sandwich plate to the shell hood in a particularly favourable manner, the at least one sandwich plate in a longitudinal section profile of the silencer can comprise a with respect to the longitudinal direction first and second end portion, in which a wall thickness of the sandwich plate has a lower value than in a region of the sandwich plate arranged between the two end portions. The sandwich plate can then be riveted on the two end portions to marginal portions of the shell hood which are complementary to these two end portions.

The invention furthermore relates to an exhaust system, in particular for an internal combustion engine of a motor vehicle, with an exhaust gas discharge pipe for discharging exhaust gas from the exhaust system and with a silencer having one or a plurality of the features mentioned before. The pipe arrangement of the silencer in this case can comprise a feed pipe which is fluidically connected to the exhaust gas discharge pipe.

The present invention furthermore relates to an internal combustion engine with a combustion chamber and an exhaust system having one or a plurality of the features mentioned before, wherein the combustion chamber of the internal combustion engine can be fluidically connected to the exhaust system by means of a connecting pipe.

Further important features and advantages of the invention are obtained from the subclaims, from the drawings and from the associated Figure description by means of the drawings.

It is to be understood that the features mentioned above and still to be explained in the following cannot only be used in the respective combination stated but also in other combinations or by themselves without leaving the scope of the present invention.

A preferred exemplary embodiment of the invention is shown in the drawings and is explained in more detail in the following description. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
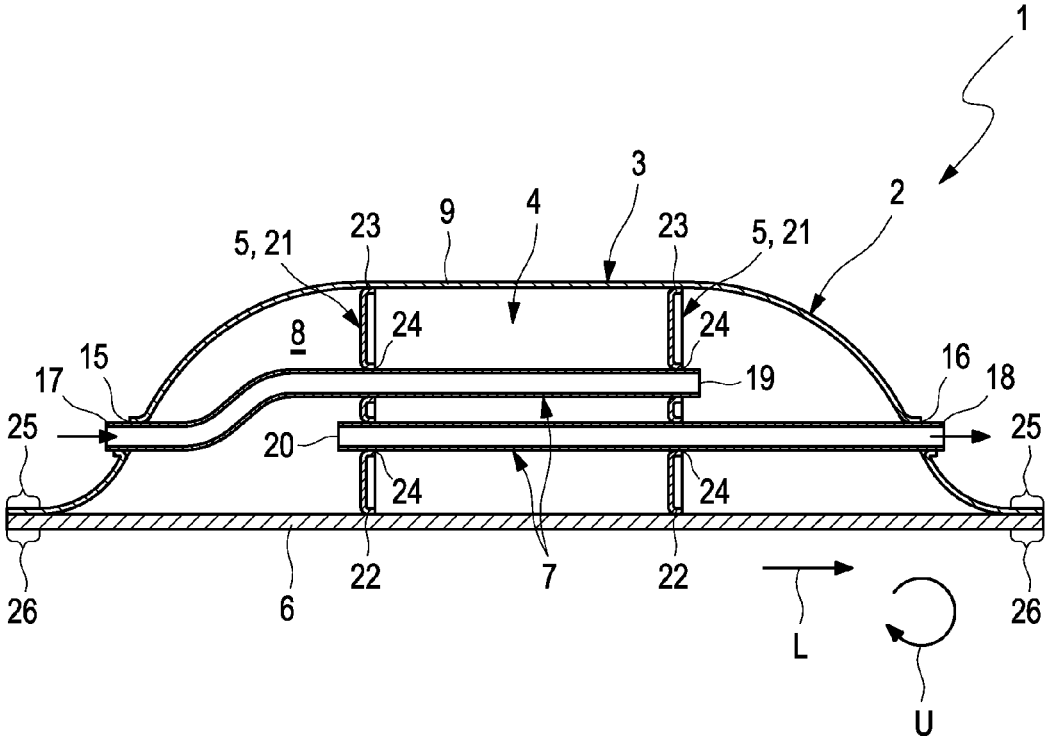
FIG. 1 is a longitudinal sectional view of a first exemplary embodiment of a silencer according to the invention.
Figure 2:
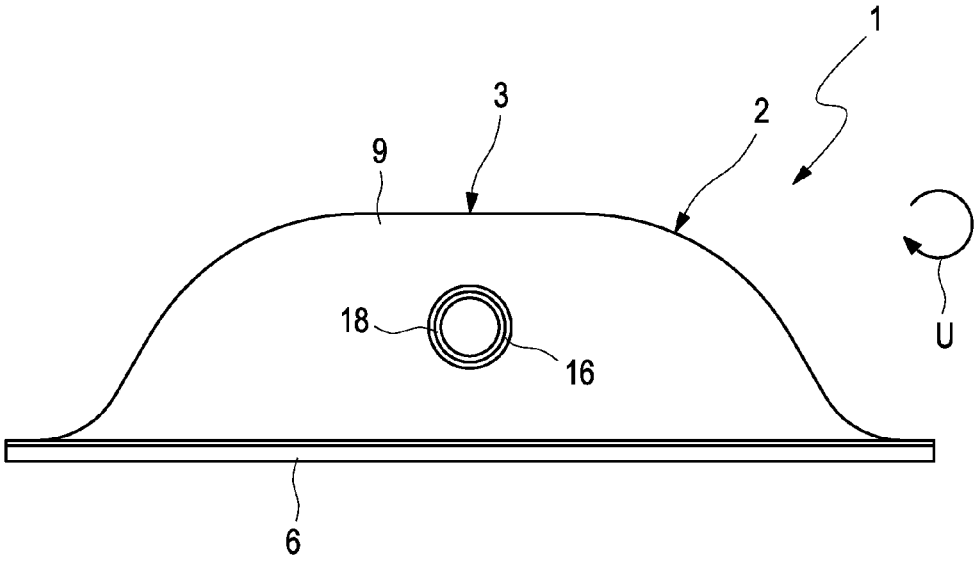
FIG. 2 is a lateral view of the silencer of FIG. 1.

Referring to the drawings in particular, in the FIGS. 1 and 2, a silencer according to the invention is shown and designated 1. FIG. 1 shows the silencer 1 in a longitudinal section view and FIG. 2 shows the silencer 1 in a lateral view.

The silencer 1 comprises a housing 2, which comprises a housing shell 3 extending in a circumferential direction U of the housing. The silencer 1 furthermore comprises a housing interior space 4 comprising at least one chamber 8, which housing interior space 4 is enclosed by the housing 2, and a self-supporting support structure 5 and a sandwich plate 6. The sandwich plate 6 in this case forms a part of the housing shell 3. The self-supporting support structure 5 comprises a pipe arrangement 7, which is partially arranged in the housing interior space 4. The silencer 1 furthermore comprises a shell hood 9, which completes the first sandwich plate 6 to form the housing shell 3 (see FIG. 2). The sandwich plate 6 can be joined to the shell hood 9 by means of welding, gluing or soldering.

Considering the representation of FIG. 2, it is evident that because of its shell-like design, the shell hood 9 does not only complete the sandwich plate 6 to form the housing shell 3 but to form the entire housing 2. This means, in particular, that for completing the housing shell 3 no additional end bottoms are required, which greatly simplifies the construction and thus the production of the silencer 1 according to the invention. From an alternative point of view, the shell hood 9 can also be considered as being integrally joined to a first and second end bottom.

Figure 3:
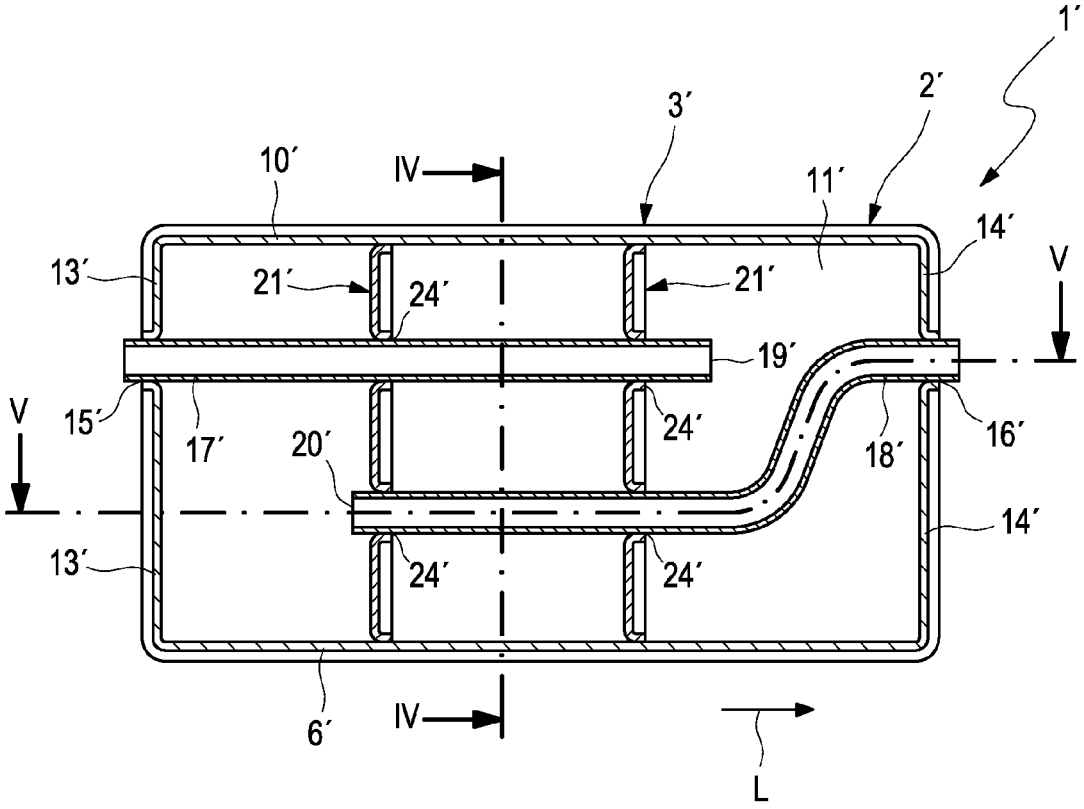
FIG. 3 is a side sectional view of a variant of the exemplary embodiment of FIG. 1.
Figure 4:
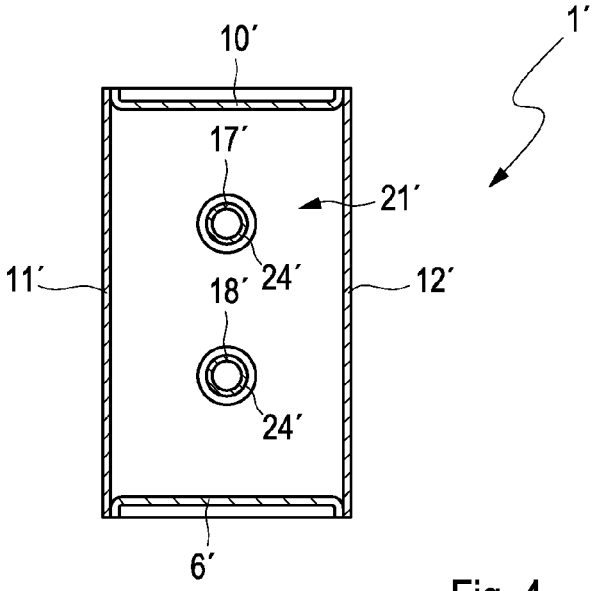
FIG. 4 is a sectional view of the silencer of FIG. 3 according to the line IV-IV of FIG. 3.

In a variant of the exemplary embodiment of FIG. 1 shown in FIG. 3, the silencer 1' can alternatively to the shell hood 9 comprise a further sandwich plate 10', which is part of the self-supporting support structure and a first and a second sheet metal wall 11', 12'. Together, these then complete the first sandwich plate 6' to form the housing shell 3'. FIG. 4 shows the silencer 1' of FIG. 3 according to the section line IV, and FIG. 5 shows the silencer 1' according to the section line V.

The sandwich plate 6' and the further sandwich plate 10' as well as the first and second sheet metal wall 11', 12' can be arranged in the cross-sectional profile of the silencer 1' preferentially substantially located opposite one another. In principle, other arrangement geometries are also conceivable, however, in further variants.

Figure 5:
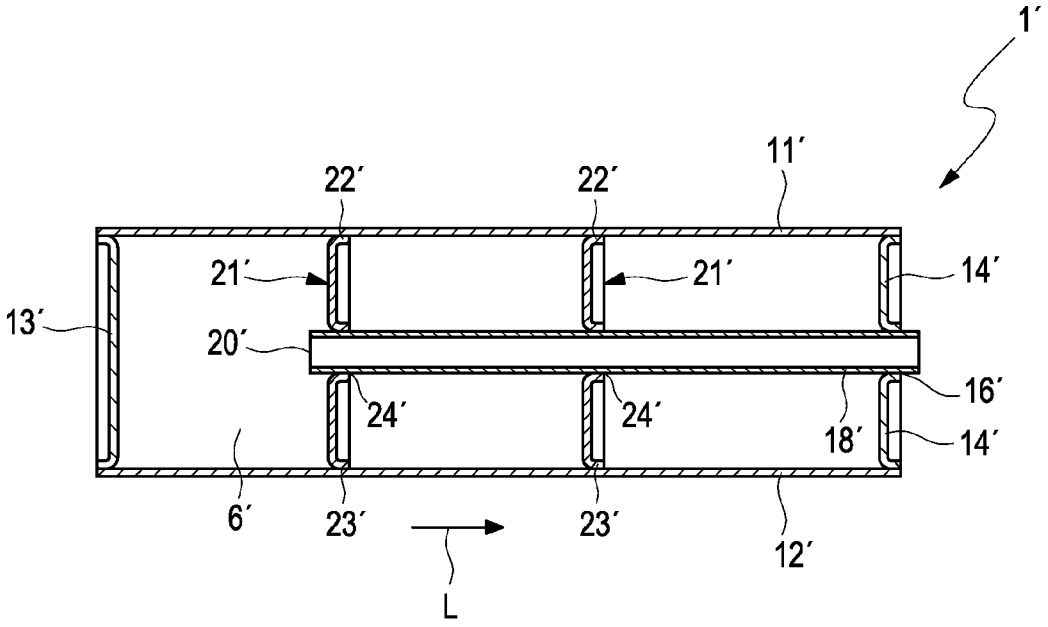
FIG. 5 is a sectional view of the silencer of FIG. 3 according to the line V-V of FIG. 3.

In the variant according to FIGS. 3 to 5, the first and second sheet metal wall 11', 12' simultaneously also form a first and a second end bottom 13', 14', which complete the housing shell 3' to form the housing 2', i.e. the sheet metal walls 11', 12' and the end bottoms 13', 14' are integrally joined to one another and form a frame-like structure in the manner of a surrounding U-profile (see FIGS. 4 and 5). In a variant, the sheet metal walls 11', 12' and the end bottoms 13', 14' can also be each formed separately and welded to one another. The end bottoms 13', 14' and the sheet metal walls 11', 12' can be glued or soldered to the sandwich plates 6', 10'.

Again, considering the representation of FIGS. 1 and 2 it is evident that the shell floor 9 has a first and second through-opening 15, 16 and that the pipe structure 7 of the silencer 1 comprises a feed pipe and a discharge pipe 17, 18 with a feed opening and discharge opening 19, 20 respectively, which are channeled through the housing interior space 4 from the outside through the first and second through-opening 15, 16 respectively. The feed opening and discharge opening 19, 20 in this case is arranged in the chamber 8. The same applies mutatis mutandis to the variant of the exemplary embodiment according to FIGS. 3 to 5. In this case, the first and second through-opening 15', 16' can be provided in the first and second end bottom 13', 14' respectively (see FIG. 3).

To further improve the mechanical stability, the silencer 1, 1' as shown in FIGS. 1, 3 and 5 can comprise two intermediate floors 21, 21' each with a first and a second end portion 22, 23, 22', 23', wherein the first end portion 22, 22' supports itself on the first sandwich plate 6, 6' and the second end portion 23, 23', on the shell hood 9 (see FIG. 1) or on the second sandwich plate 10' (see FIG. 4). The intermediate floors 21, 21' can be glued or soldered to the sandwich plates 6, 6', 10' and be welded to the shell hood 9, the sheet metal walls 11', 12' and to the end bottoms 13, 14'.

In the two intermediate floors 21, 21', through-openings 24, 24' are provided in a region arranged between the first and second end portion, through which the feed pipe and discharge pipe 17, 18, 19', 18' are channeled. It is clear that in variants another number of intermediate floors can also be provided in the silencer 1, 1'.

In the representation of FIGS. 1, 3 and 5, the intermediate floors 21, 21' are formed as thin sheet metal walls. Depending on which additional mechanical stiffening is to be achieved by means of the additional intermediate floors 21, 21', these can in principle be formed either as mechanically particularly stable sandwich plate or as a thin sheet metal wall which can be produced in a particularly cost-effective manner. Combinations in the manner that individual intermediate floors 21, 21' are formed as thin sheet metal wall and further intermediate floors 21, 21' as sandwich plates, are also conceivable.

In variants of the exemplary embodiment, the at least one sandwich plate 6, 6' or/and the at least one intermediate floor 21, 21' can be part of the self-supporting support structure 5.

From the representation of FIG. 1, it is evident that for the particularly stable fastening to the sandwich plate 6 the shell hood 9 in a longitudinal section profile of the silencer 1 can comprise two marginal portions 25, which project to the outside, away from the housing interior space 4. In an alternative variant, the marginal portions 25 can obviously also project to the inside, towards the housing interior space.

Alternatively, or additionally, the sandwich plate 6, 6' in the longitudinal profile of the silencer 1 can have with respect to a longitudinal direction L of the silencer 1 a first and second end portion 26, in which a wall thickness D of the sandwich plate 6 has a lower value $D_1$ than in a region of the sandwich plate 6 arranged between the two end portions 26. This is roughly schematically shown in the representation of FIG. 6, which shows the sandwich plate 6 with an end portion 26. In a variant, the end portions 26 can also be formed as folded portions, which engage about the marginal portions 25 of the shell hood 9. This is roughly schematically shown in FIG. 7. In the region of the end portions 26, the shell hood 9 can then be additionally fastened to the sandwich plate 6 by means of gluing or soldering. Alternatively, it is also conceivable that the marginal portions 25 of the shell hood 9 are formed as folding portions, which engage about the end portions 26 of the sandwich plate 6.

Figure 6:
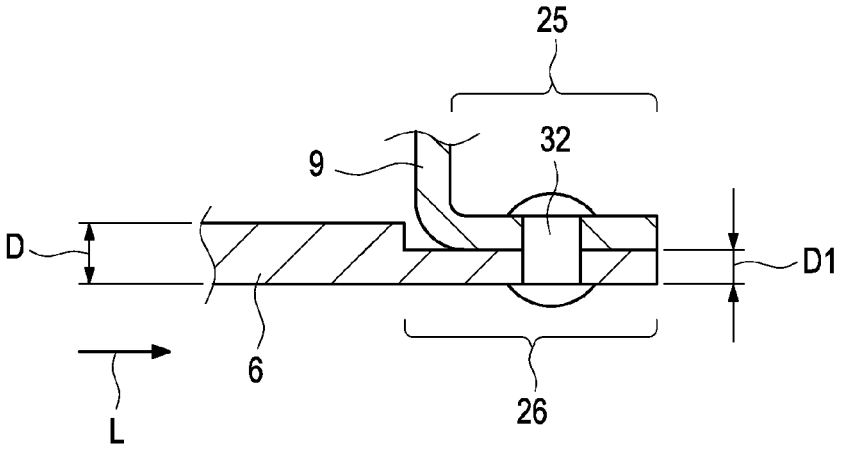
FIG. 6 is a partial sectional view of the silencer of FIG. 1.
Figure 7:
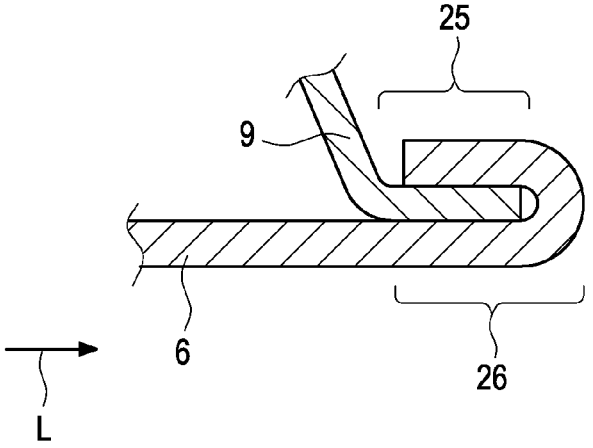
FIG. 7 a partial sectional view of a variant of the partial sectional view of FIG. 6.

As is evident from the representation of FIG. 6, the sandwich plate 6 for the purpose of a particularly stable fastening to the shell hood 9 can be riveted in the region 25 and 26 (see reference number 32 in FIG. 6).

Figure 8:
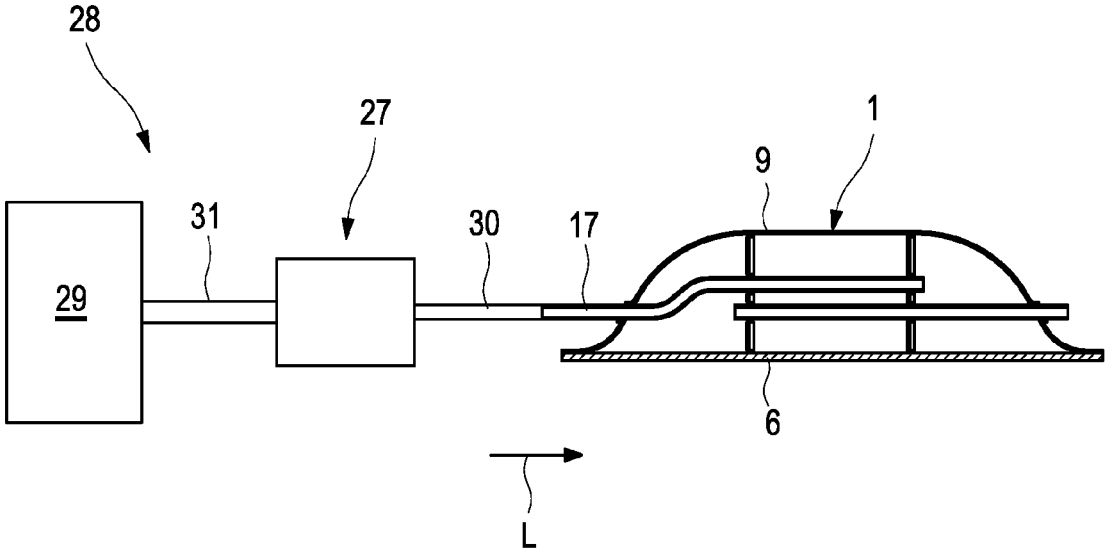
FIG. 8 the silencer according to the invention as part of an exhaust system or of an internal combustion engine in a rough schematic representation.

In the rough schematic representation of FIG. 8 it is shown that the silencer 1 can be part of an exhaust system 27, in particular for an internal combustion engine of a motor vehicle, which in turn can be equipped with an exhaust gas discharge pipe 30 for discharging exhaust gas from the exhaust system 27. The exhaust gas discharge pipe 30 in this case is fluidically connected to the feed pipe 17 of the silencer 1. The exhaust system 27 in turn can be part of an internal combustion engine 28 with a combustion chamber 29, wherein the combustion chamber 29 of the internal combustion engine 28 is fluidically connected to the exhaust system 27 by means of a connecting pipe 31.

While specific embodiments of the invention have been shown and described in detail to illustrate the application of the principles of the invention, it will be understood that the invention may be embodied otherwise without departing from such principles.

What is claimed is:

1. A silencer for an exhaust system of an internal combustion engine, the silencer comprising:

a housing comprising a housing shell extending in a circumferential direction of the housing, the housing shell comprising a shell hood and a sandwich plate attached to the shell hood and forming a part of the housing shell, wherein the sandwich plate is comprised of a plurality individual sheet metal wall layers, the housing defining a housing interior space comprising at least one chamber, which is enclosed by the housing, the sandwich plate and the shell hood cooperating to complete the housing shell, forming an entirety of an outer surface of the housing; and a self-supporting support structure comprising a pipe arrangement partially arranged in the housing interior space, the pipe arrangement comprising at least one pipe extending through said shell hood, the pipe being formed as a discrete tubular one piece pipe.

2. The silencer according to claim 1, wherein the sandwich plate is part of the self-supporting support structure.

3. The silencer according to claim 1, wherein the self-supporting support structure further comprises at least one intermediate floor.

4. The silencer according to claim 1, wherein the shell hood, in a longitudinal section profile of the silencer, comprises two marginal portions attached to the sandwich plate, the two marginal portions project to an outside, away from the housing interior space, or project to an inside, towards the housing interior space.

5. The silencer according to claim 1, wherein:

the shell hood comprises a first and a second through-opening; and the pipe arrangement comprises a feed pipe and a discharge pipe, with a feed opening and a discharge opening respectively, which are channeled through the first and second through-opening respectively from the outside into the housing interior space.

6. The silencer according to claim 5, wherein:

the self-supporting support structure further comprises at least one intermediate floor;

the at least one intermediate floor comprises a first end portion and a second end portion;

the first end portion is attached to the sandwich plate and the second end portion is attached to the shell hood; and the intermediate floor, in a region arranged between the first end portion and the second end portion, comprises at least one through-opening, through which the at least one feed pipe or discharge pipe is channeled.

7. The silencer according to claim 3, wherein the at least one intermediate floor is an additional sandwich plate or a sheet metal wall.

8. The silencer according to claim 3, wherein the sandwich plate is joined to the intermediate floor by means of welding, gluing or soldering.

9. A silencer for an exhaust system of an internal combustion engine, the silencer comprising:

a housing comprising a housing shell extending in a circumferential direction of the housing, the housing shell comprising a shell hood and a sandwich plate attached to the shell hood and forming a part of the housing shell, the housing defining a housing interior space comprising at least one chamber, which is enclosed by the housing, the sandwich plate and the shell hood cooperating to complete the housing shell, forming an entirety of an outer surface of the housing; and a self-supporting support structure comprising a pipe arrangement partially arranged in the housing interior space, the pipe arrangement comprising at least one pipe extending through said shell hood, wherein:

the sandwich plate, in a longitudinal section profile of the silencer, and with respect to the longitudinal direction, comprises a first end portion and a second end portion, in which a wall thickness of the sandwich plate has a lower value than in a region of the sandwich plate arranged between the two end portions; and the sandwich plate, on the two end portions, is riveted to the marginal portions of the shell hood which is complementary to the two end portions.

10. An exhaust system for an internal combustion engine of a motor vehicle, the exhaust system comprising:

an exhaust gas discharge pipe for discharging exhaust gas from the exhaust system;

a silencer comprising a housing comprising a housing shell extending in a circumferential direction of the housing, the housing shell comprising a shell hood and a sandwich plate attached to the shell hood and forming a part of the housing shell, wherein the sandwich plate is comprised of a plurality individual sheet metal wall layers, the housing shell defining a housing interior space comprising at least one chamber, which is enclosed by the housing shell, the sandwich plate and the shell hood cooperating to complete the housing shell, forming an entirety of an outer surface of the housing and defining a self-supporting support structure comprising a pipe arrangement partially arranged in the housing interior space, wherein the pipe arrangement comprises a feed pipe which is fluidically connected to the exhaust gas discharge pipe, the feed pipe being formed as a discrete tubular one piece pipe.

11. The exhaust system according to claim 10 in combination with an internal combustion engine comprising a combustion chamber; and a connecting pipe, wherein the combustion chamber is fluidically connected to the exhaust system by the connecting pipe.

12. An exhaust system muffler of an internal combustion engine, the muffler comprising:

a housing with a housing shell comprising a shell hood and a sandwich plate comprised of a plurality individual sheet metal wall layers forming a part of the housing shell, the housing providing a housing interior space comprising at least one chamber, which is enclosed by the housing shell, the sandwich plate and the shell hood cooperating to complete the housing shell, forming an entirety of an outer surface of the housing; and a self-supporting support structure comprising a pipe arrangement partially in the housing interior space, the pipe arrangement comprises a tubular one piece pipe.

13. The muffler according to claim 12, wherein:

the self-supporting support structure further comprises an intermediate structural member within the housing, the intermediate structural member being connected to the one piece pipe of the pipe arrangement; and the sandwich plate is connected to the intermediate structural member and forms a part of the self-supporting support structure.

* * * * *